US006453858B2

(12) United States Patent
Scheidt et al.

(10) Patent No.: US 6,453,858 B2
(45) Date of Patent: Sep. 24, 2002

(54) DEVICE FOR VARYING VALVE TIMING OF GAS EXCHANGE VALVES OF INTERNAL COMBUSTION ENGINES, PARTICULARLY A HYDRAULIC CAMSHAFT ADJUSTING DEVICE OF A ROTARY PISTON TYPE

(75) Inventors: Martin Scheidt, Adelsdorf; Andreas Strauss, Forchheim; Michael Haag, Nürnberg, all of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/915,871

(22) Filed: Jul. 26, 2001

(30) Foreign Application Priority Data

Jul. 27, 2000 (DE) ..... 100 36 546

(51) Int. Cl.[7] ..... F01L 1/34
(52) U.S. Cl. ..... 123/90.17; 123/90.15
(58) Field of Search ..... 123/90.17, 90.12, 123/90.15, 90.16; F01L 1/34

(56) References Cited

FOREIGN PATENT DOCUMENTS

| | | | |
|---|---|---|---|
| DE | 19844473 | 4/1999 | |
| EP | 0 536 237 B1 * | 4/1993 | ..... F01L/1/34 |

* cited by examiner

*Primary Examiner*—Thomas Denion
*Assistant Examiner*—Sean O'Brien

(74) *Attorney, Agent, or Firm*—Bierman, Muserlian and Lucas

(57) ABSTRACT

The invention concerns a device for varying valve timing of gas exchange valves of an internal combustion engine, particularly a hydraulic camshaft adjusting device of a rotary piston type, said device comprising a drive pinion (2) connected in driving relationship to a crankshaft of the internal combustion engine and a winged wheel (3) connected rotationally fast to a camshaft of the internal combustion engine. The drive pinion (2) comprises a hollow space formed by a circumferential wall (4) and two side walls (5, 6), at least one hydraulic working chamber (10) being formed in the hollow space by at least two limiting walls (8, 9). The winged wheel (3) comprises at least one radial wing (12), and with each wing (12) it divides one hydraulic working chamber (10) into two hydraulic pressure chambers (13, 14) which, when pressurized by a hydraulic pressure medium effect a pivoting or a fixing of the winged wheel (3) relative to the drive pinion (2). When the internal combustion engine is switched off, the camshaft is rotated into a preferred basic position for starting the internal combustion engine, and in this position, the winged wheel (3) can be mechanically coupled to the drive pinion (2) by a lock. The novel lock is configured as a cage-guided free-wheel (16) arranged between the winged wheel (3) and the drive pinion (2) and comprises at least one clamping body (17) that blocks the direction of rotation of the winged wheel (3) opposed to the basic position of the camshaft. The cage (18) of the free-wheel (16) is configured at least partly as a pressure application surface (19) for the hydraulic pressure medium for unlocking the free-wheel (16).

7 Claims, 2 Drawing Sheets

DEVICE FOR VARYING VALVE TIMING OF GAS EXCHANGE VALVES OF INTERNAL COMBUSTION ENGINES, PARTICULARLY A HYDRAULIC CAMSHAFT ADJUSTING DEVICE OF A ROTARY PISTON TYPE

FIELD OF THE INVENTION

The invention concerns a device for varying valve timing of gas exchange valve of an internal combustion engine, particularly a hydraulic camshaft adjusting device of a rotary piston type comprising:

a drive pinion connected in driving relationship to a crankshaft of the internal combustion engine and a winged wheel connected rotationally fast to a camshaft of the internal combustion engine, said drive pinion comprising a hollow space formed by a hollow cylindrical circumferential wall and two side walls, at least one hydraulic working chamber being formed in the hollow space by at least two radial limiting walls, at least one wing arranged on an outer periphery of a wheel hub of the winged wheel extending radially into the at least one working chamber and dividing this working chamber into two oppositely acting hydraulic pressure chambers, by a selective or simultaneous pressurizing by a hydraulic pressure medium, the pressure chambers effect a pivoting or a fixing of the winged wheel relative to the drive pinion, and thus, of the camshaft relative to the crankshaft, on switching-off of the internal combustion engine, an auxiliary energy acting between the winged wheel and the drive pinion rotates the camshaft into a preferred basic position for starting the internal combustion engine, in the basic position of the camshaft, the winged wheel can be mechanically coupled to the drive pinion by a lock that can be hydraulically unlocked again upon renewed pressurizing of the device.

BACKGROUND OF THE INVENTION

A generic device of the pre-cited type is known from DE 198 44 473 A1. This device configured as a so-called vane-type adjusting device essentially comprises a drive pinion connected in driving relationship to a crankshaft of the internal combustion engine and a winged wheel connected rotationally fast to a camshaft of the internal combustion engine. The drive pinion comprises a hollow space formed by a hollow cylindrical circumferential wall and two side walls, four hydraulic working chambers being formed in this hollow space by four radial limiting walls. On the periphery of its wheel hub, the winged wheel correspondingly comprises four wings each of which extends radially into one of the working chambers of the drive pinion and divides the working chamber into two oppositely acting hydraulic pressure chambers. When selectively or simultaneously pressurized by a hydraulic pressure medium, these pressure chambers effect a pivoting or a fixing respectively, of the winged wheel relative to the drive pinion, and thus, of the camshaft relative to the crankshaft. When the internal combustion engine is switched off, an auxiliary energy acting between the winged wheel and the drive pinion rotates the camshaft into a preferred basic position for starting the internal combustion engine, in which position, the winged wheel can be mechanically coupled to the drive pinion by a lock. The lock of this device is a spring-loaded locking pin that is movably arranged in a radial bore of a limiting wall of the drive pinion and that, in the basic position of the camshaft, snaps into a radial reception bore arranged in the wheel hub of the winged wheel between two wings. The reception bore is in hydraulic communication with the pressure medium supply to those pressure chambers that have a minimized volume in the basic position of the camshaft so that, due to the pressure loading of these pressure chambers at a re-starting of the internal combustion engine, the locked locking pin is pushed against the action of its spring load into the radial bore in the limiting wall and is thus hydraulically unlocked again.

Another possibility of mechanically coupling the winged wheel to the drive pinion of a camshaft adjusting device of a rotary piston type is known from the device disclosed in DE-OS 196 23 818. The structure of this device configured as a so-called pivoting wing adjuster corresponds basically to that of the vane-type adjuster described above except that the wings of its winged wheel are more massive and that it generally comprises only two to three hydraulic working chambers. The mechanical coupling of the winged wheel to the drive pinion is effected in this device by a likewise spring-loaded locking pin that is slidably arranged in an axial bore in a wing of the winged wheel and that, in the basic position of the camshaft, snaps into an axial reception bore in one of the side walls of the drive pinion. Similar to the previously described device, this reception bore communicates with the pressure medium supply of the hydraulic pressure chambers of the device acting in one direction so that, when these pressure chambers are pressurized, the locked locking pin is hydraulically unlocked again in a similar manner and is pushed into the axial bore in the wing of the winged wheel.

These locks in the form of a radial locking pin and an axial locking pin for coupling the winged wheel and the drive pinion of a camshaft adjusting device of a rotary piston type, however, have the drawback of being comprised of a plurality of additional, separate parts and additional pressure medium ducts and reception bores that unfavorably increase the fabrication and assembly costs and, thus, the overall manufacturing costs of such a device. A further drawback of such locks is that the end face of the locking pin usable as a pressure application surface for unlocking is relatively small so that a pressure medium pressure sufficient for unlocking takes a relatively long time to build up and thus prolongs the unlocking time of the device. Moreover, in these devices, the basic danger exists that the pressure medium pressure desired in the pressure chambers in communication with the locking pin is built up earlier in the pressure chambers themselves than on the pin and thus produces a bracing torque between the winged wheel and the drive pinion which causes a clamping of the locking pin in its locking position so that an adjustment of the device is rendered impossible.

OBJECTS OF THE INVENTION

It is an object of the invention to provide a device for varying the valve timing of gas exchange valves of an internal combustion engine, and more particularly to provide a hydraulic camshaft adjusting device of a rotary piston type in which the winged wheel and the drive pinion can be coupled mechanically to each other by a lock, the device being distinguished by the small number of its individual parts and by low fabrication and assembly costs while being configured with a pressure application surface that is large enough to assure a quick hydraulic unlocking.

This and other objects and advantages of the invention will obvious from the following detailed description.

SUMMARY OF THE INVENTION

The invention achieves the above objects by the fact that the lock for mechanically coupling the winged wheel to the drive pinion is formed by at least one cage-guided free-wheel that is arranged between the winged wheel and the drive pinion and comprises at least one clamping body that blocks the direction of rotation of the winged wheel opposed to the basic position of the camshaft, at least parts of the surface of the cage of the free-wheel being configured as a pressure application surface for the hydraulic pressure medium for a hydraulic unlocking of the free-wheel.

In a particularly preferred embodiment of the invention, it has proved to be sufficient if the lock of the device comprises only one free-wheel made according to the invention and only one clamping body is guided by its cage because this reduces the fabrication and assembly costs of the lock to a minimum. For a further reduction of costs for the lock of the device, advantageously, the clamping body of the free-wheel is configured as a simple rolling bearing needle roller and the cage of the free-wheel is made of a heat-resistant plastic. However, the invention also includes solutions in which the free-wheel comprises a plurality of clamping bodies, for example, two or more rolling bearing balls arranged next to one another and/or in which the cage is made of a material other than a plastic.

According to a further advantageous proposition of the invention, the cage of the free-wheel preferably has an L-shaped cross-sectional profile and is arranged in an angular recess which likewise has an L-shaped cross-sectional profile and is made in a limiting wall of the drive pinion. This angular recess is made at least partly in the radial end face of the limiting wall and at least partly in one of the two wing stop surfaces of the limiting wall so that the entire free-wheel is received within the original contour of the limiting wall. The wing stop surface in which the angular recess is made is preferably that lateral surface of the limiting wall which, in the pivoted position of the winged wheel corresponding to the basic position of the camshaft, delimits one of those pressure chambers of the device that are pressurized on starting of the internal combustion engine. Moreover, it is advantageous from the fabrication point of view to configure the angular recess for the free-wheel in the limiting wall over the entire axial width of the drive pinion. Although the length of the two legs of the angular recess can be chosen at will, it is advantageous to retain a smaller part of the wing stop surface of the limiting wall starting from the circumferential wall of the drive pinion and as large a part of the radial end face of the of the limiting wall in their original contours. This assures on the one hand that a stop still exists for the wing of the winged wheel that is in operative contact with this side of the limiting wall and, on the other hand, that the leak gap between the radial end face of this limiting wall and the wheel hub of the winged wheel still has an adequate length for sealing the adjoining hydraulic pressure chambers.

In an alternative configuration of the angular recess in the limiting wall of the drive pinion it is, however, also possible to configure this recess narrower than the axial width of the drive pinion so as to extend only over a part of the axial width of the drive pinion into the limiting wall. In this case it would also be conceivable to have that leg of the angular recess that is made in the wing stop surface of the limiting wall extend over the entire height of the limiting wall because the remaining part of the axial width of the limiting wall can then act as a wing stop surface for the wing of winged wheel. But such a leg of the angular recess extending over the entire height of the limiting wall is basically also possible in the preferred configuration of the angular recess extending over the entire axial width of the drive pinion because the end position of the wing in operative contact with this limiting wall is jointly defined also by the stop surfaces for the other wings of the winged wheel.

According to a further advantageous proposition of the invention, the first profile leg of the L-shaped cage of the free-wheel is configured on one side as a pressure application surface for the hydraulic pressure medium and, on the other side, it cooperates with a spring means that is supported on the recessed portion of the wing stop surface of the limiting wall and acts in locking direction of the free-wheel. The pressure application surface on this first profile leg is formed by that one of its two lateral surfaces that is oriented towards the pressure chamber that is pressurized on starting of the internal combustion engine. The size of this pressure application surface is determined by the choice of the above-mentioned alternatives of configuration of the angular recess because, to avoid an undesired pressure build-up behind the free-wheel, the first profile leg of the cage of the free-wheel arranged in the recessed portion of the wing stop surface must seal the angular recess as pressure-medium tightly as possible, which means that its pressure application surface must basically have approximately the same dimensions as the recessed portion of the wing stop surface of the limiting wall. Besides the aforesaid advantages obtained in fabrication by making the angular recess extend in the limiting wall over the entire axial width of the drive pinion, with a cage of corresponding configuration inserted into this angular recess, this has also proved to be of advantage for obtaining as large a pressure application surface as possible on the first profile leg of the cage because, in this way, already upon a slight pressure build-up in the pressure chambers of the device that are pressurized on starting of the internal combustion engine, an adequate force for the hydraulic unlocking of the free-wheel is applied to the pressure application surface.

If the cage is made of a plastic or even as a bent stamping, the spring means acting in the locking direction of the free-wheel can be formed particularly advantageously by one or more spring tongues formed integrally on and at an acute angle to the lateral surface of the first profile leg situated opposite from the pressure application surface. The spring force of these spring tongues can be defined by their angular position and/or by their material thickness. Alternatively, separately made spring means, for example, flat bent springs, coiled compression springs or elastomer pads and the like may also be used. These may be fixed on the recessed portion of the wing stop surface of the limiting wall or on the first profile leg of the cage and be supported on the respective opposite surface.

According to a further proposed feature of the first profile leg of the cage of the free-wheel, the free end of this leg has an integrally formed collar with a circular profile cross-section with which the cage of the free-wheel can be positively arrested in a circular groove additionally provided in the recessed portion of the wing stop surface of the limiting wall. This circular groove is preferably arranged near the hollow angle formed by the angular recess in the wing stop surface, and similar to the angular recess, this groove, too, is made in the limiting wall over the entire axial width of the drive pinion. The collar with the circular profile cross-section is offset at an angle of about 45° to this profile leg preferably by bending the edge portion of the first profile leg, so that, after the mounting of the cage by sideward pushing into the circular groove, an intermediate space is formed between the profile leg and the recessed portion of the wing stop surface for receiving the spring means of the free-wheel and the required freedom of the cage to pivot within its catch is guaranteed at the same time. It is, however, also conceivable to configure the first profile leg of the cage with its end portion bent into a Z-shaped profile and fix it by screwing or the like in the recessed portion of the wing stop surface on the limiting wall. The central bar of the Z-shaped profile could then also form the spring means of the free-wheel.

According to a further feature of the device of the invention, the second profile leg of the cage of the free-wheel is inserted into that part of the angular recess that is made in the radial end face of the limiting wall of the drive pinion, so that the clamping body of the free-wheel mounted in this profile leg is arranged between the outer peripheral surface of the wheel hub of the winged wheel and the recessed portion of the radial end face of the limiting wall. For enabling the locking action of the free-wheel, the distance of the limiting-wall-side end region of the recessed portion of the radial end face of the limiting wall from the outer peripheral surface of the wheel hub of the winged wheel is larger than the diameter of clamping body of the free wheel, while the distance of the pressure-chamber-side end region of the recessed portion of the radial end face from the outer peripheral surface of the wheel hub of the winged wheel is smaller than the diameter of the clamping body. The resulting conical taper of the part of the angular recess thus formed in the radial end face of the limiting wall extends in the locking direction of the free-wheel and is preferably configured with an angle lying within the self-locking range of the clamping body of the free-wheel. In this way, when the internal combustion engine is switched off, or when the pressure medium pressure in the pressure chamber of the device delimited by the free-wheel falls short of a certain value, the clamping body of the free-wheel is displaced by the spring means arranged on the cage of the free-wheel out of its unlocking position in the limiting-wall-side end region of the recessed portion of the radial end face of the limiting wall, in which position the clamping body is retained till then by the pressure medium pressure, into its locking position in the pressure-chamber-side end region of the recessed portion of the radial end face and braces the drive pinion and the winged wheel of the device against each other, that is to say, the drive pinion and the winged wheel are thus coupled mechanically to each other. If, at this moment, the pivoted position of the winged wheel does not correspond to the preferred basic position of the camshaft for a re-starting of the internal combustion engine, the alternating torques of the camshaft persisting during the run-out phase of the internal combustion engine at the same time form the auxiliary energy for displacing the winged wheel into this basic position due to the fact that the component of the alternating torques acting against the locking direction of the free-wheel and not impeded by this, is utilized for pivoting the winged wheel toward the basic position, while the component of the alternating torques acting in the locking direction of the free-wheel is impeded or cut off by the free-wheel.

Finally, according to a further feature of device of the invention, the hollow space formed in unlocking direction behind the clamping body between the recessed portion of the radial end face of the limiting wall of the drive pinion and the outer peripheral surface of the wheel hub of the winged wheel can be depressurized preferably through an additional vent duct. This vent duct is preferably configured as a radial groove made in one of the side walls of the drive pinion, which groove begins as a continuation of the radial step formed in this limiting wall by the angular recess in the radial end face of the limiting wall and opens within the device into a pressure medium duct leading into the cylinder head of the internal combustion engine. The vent duct assures that no leakage-caused pressure medium bolster is formed in the hollow space behind the clamping body, which bolster would render more difficult or even prevent a movement of the free-wheel into its unlocking position when the internal combustion engine is started or when the pressure chamber delimited by the free-wheel is pressurized, and further assures that the hydraulic pressure medium collecting in this hollow space is constantly discharged from the device as a leakage. To further improve the pressure relief in the hollow space arranged behind the clamping body, it is also possible to provide such radial grooves acting as vent ducts not only in one of the side walls but in both side walls of the drive pinion.

The device of the invention for varying the valve timing of gas exchange valves of an internal combustion engine, particularly a hydraulic camshaft adjusting device of a rotary piston type therefore possesses the advantage over known prior art devices that the lock for the mechanical coupling of the drive pinion to the winged wheel is embodied in a free-wheel of a simple structure that is distinguished by a minimum number of individual parts and low fabrication and assembly costs and therefore permits an extremely economic manufacturing of the device of the invention. Besides this, in a device having such a locking arrangement, the entire surface of the first profile leg of the L-shaped cage of the free-wheel is configured as a pressure application surface that can be used for unlocking the device so that the pressure required for unlocking is built up as rapidly as possible and, compared to mechanical locking arrangements, the unlocking time is shortened. Moreover, due to the structure and the mode of operation of the free-wheel lock of the device of the invention, a pressure medium pressure acting in the pressure chambers that are the first to be pressurized upon starting of the internal combustion engine cannot produce a bracing torque between the drive pinion and the winged wheel that would obstruct an adjustment of the device, so that the locking and unlocking reliability of the free-wheel lock of the invention is higher than that of known mechanical locks.

The invention will now be described more closely with reference to an example of embodiment and the appended drawings.

DETAILED DESCRIPTION OF THE DRAWINGS

Figure 1:
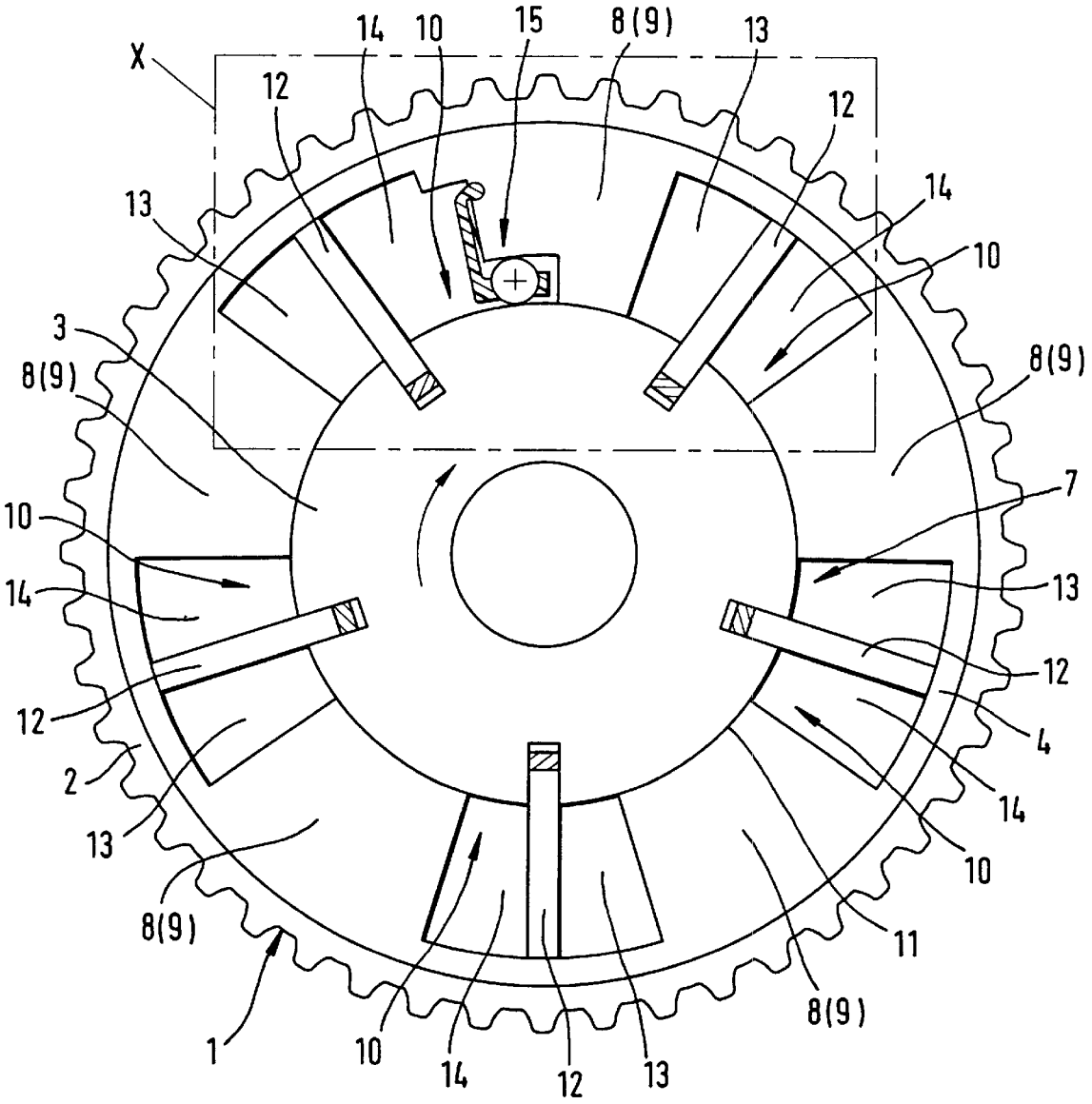
FIG. 1 is a top view of a rotary piston type camshaft adjusting device of the invention, with the side wall situated opposite from the camshaft removed.

FIG. 1 clearly shows a device 1 configured as a rotary piston type hydraulic camshaft adjusting device which serves to vary the opening and closing times of gas exchange valves of an internal combustion engine. This device 1 generally comprises a drive pinion 2 that is in driving relationship to a crankshaft, not shown, of the internal combustion engine and a winged wheel 3 that is connected rotationally fast to a camshaft, also not shown, of the internal combustion engine. The drive pinion 2 comprises a hollow space 7 defined by a hollow cylindrical circumferential wall 4 and two side walls 5, 6, roughly indicated in FIG. 2. Five hydraulic working chambers 10 are formed in the hollow space 7 by five radial limiting walls 8, 9. FIG. 1 further shows that five wings. 12, each of which extends radially into one of the working chambers 10 of the drive pinion 2, are arranged on the periphery of the wheel hub 11 of the winged wheel 3. The wings 12 divide each working chamber 10 into two oppositely acting pressure chambers 13, 14 which, when selectively or simultaneously pressurized by a hydraulic pressure medium, effect a pivoting or a fixing, respectively, of the winged wheel 3 relative to the drive pinion 2 and, thus also, of the camshaft relative to the crankshaft.

A further feature of the device 1 represented in FIG. 1 is that, when the internal combustion engine is switched off, the camshaft is rotated by an auxiliary energy acting between the winged wheel 3 and the drive pinion 2 into a preferred basic position for starting the engine. In this position, the winged wheel 3 can be mechanically coupled to the drive pinion 2 by a lock 15 that can be unlocked again hydraulically upon a renewed pressurization of the device 1. According to the invention, this lock 15 is formed in the present embodiment of the device 1 by a cage-guided free-wheel 16, shown in detail in FIG. 2, that is arranged between the drive pinion 2 and the winged wheel 3. The free-wheel 16 comprises a clamping body 17 that blocks the direction of rotation of the winged wheel 3 opposed to the basic position of the camshaft, at least parts of the surface of the cage 18 of the free-wheel 16 forming, at the same time, a pressure application surface 19 for the hydraulic pressure medium for the hydraulic unlocking of the free-wheel 16. The device 1 shown in the drawings, is represented by way of example as a vane-type adjusting device that is mounted on an inlet camshaft and whose winged wheel 3 can be coupled to the drive pinion 2 in the basic position indicated by an arrow in FIG. 1 and corresponding to a "retard position" of the camshaft. The free-wheel 16 of this device comprises a clamping body 17 in the form of a rolling bearing needle roller and a cage 18 made of a heat-resistant plastic.

Figure 2:
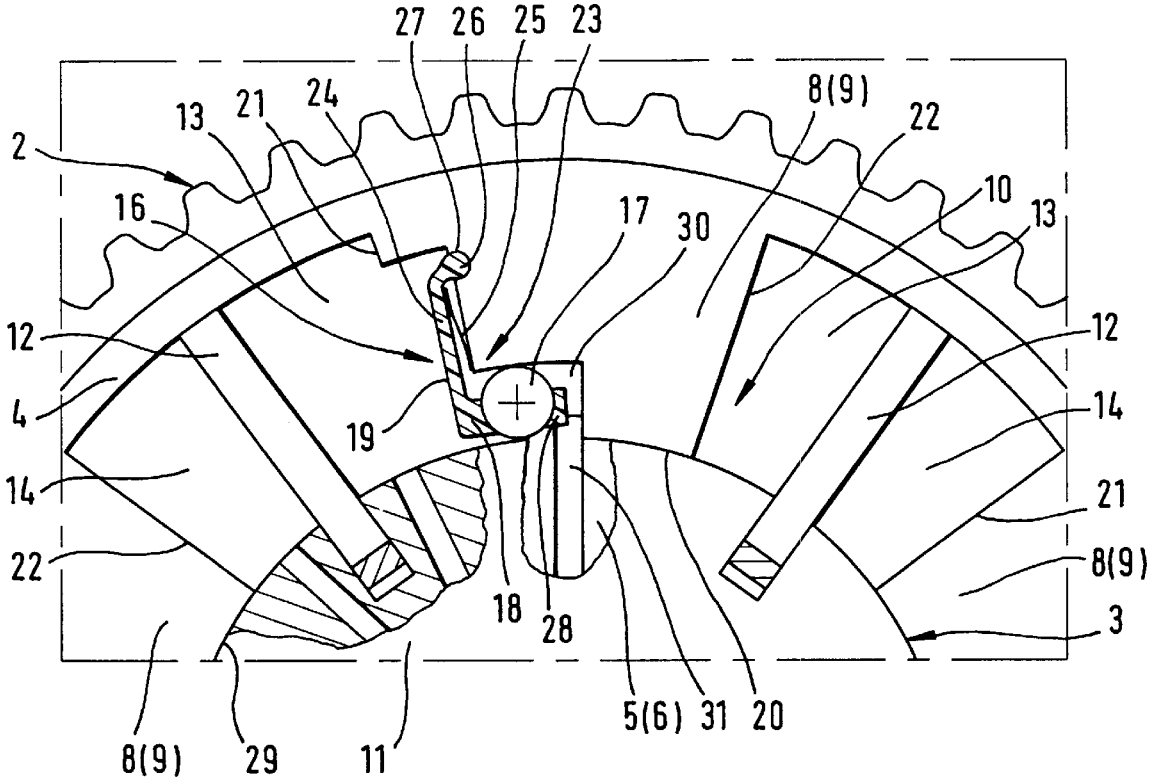
FIG. 2 is an enlarged view of the detail X of FIG. 1 showing the freewheel lock of the camshaft adjusting device of the invention.

FIG. 2 further clearly shows that the cage 18 of the free-wheel 16 has an L-shaped cross-sectional profile and is arranged within a likewise L-shaped angular recess 23 that is made partly in the radial end face 20 and partly in the wing stop surface 21 of a limiting wall 9 of the drive pinion 2 and extends over the entire axial width of the drive pinion 2. In a device 1 mounted on an outlet camshaft, the angular recess 23 would be made laterally reversed in the wing stop surface 22 and in the radial end face 20 of a limiting wall 8.

The pressure application surface 19 for the hydraulic pressure medium is configured on that lateral surface of the first profile leg 24 of the cage 18 of the free-wheel 16 that is oriented towards that pressure chamber 13 which is pressurized upon starting of the internal combustion engine, while on the opposite lateral surface of the first profile leg 24 a spring means 25 is arranged that is supported on the recessed portion of the wing stop surface 21 of the limiting wall 9 and acts in locking direction of the free-wheel 16. This spring means 25 is configured as a plastic spring tongue that is integrally formed at an acute angle on this profile leg 24 and likewise extends over the entire axial width of the drive pinion 2. A collar 26 having a circular cross-sectional profile is formed on the free end of the first profile leg 24 of the cage 18 of the free-wheel 16 and is bent at a small angle to the end region of the profile leg 24. With this collar 26, the free-wheel 16 can be positively arrested in a circular groove 27 made in the recessed portion of the wing stop surface 21 of the limiting wall 9.

As can also be clearly seen in FIG. 2, the second profile leg 28 of the cage 18 of the free-wheel 16 thus extends into the part of the angular recess 23 that is situated in the radial end face 20 of the limiting wall 9 of the drive pinion 2 so that the clamping body 17 of the free-wheel 16 mounted in this second profile leg 28 is situated between the outer peripheral surface 29 of the wheel hub 11 of the winged wheel 3 and the recessed portion of the radial end face 20 of the limiting wall 9 of the drive pinion 2. The recessed portion of the radial end face 20 of the limiting wall 9 is configured with a conical taper in the locking direction of the free-wheel 16, so that, after the internal combustion engine has been switched off, the clamping body 17 of the free-wheel 16 is displaced by the spring means 25 arranged on the cage 18 of the free-wheel 16 out of its unlocking position in the limiting-wall-side end region of the recessed portion of the radial end face 20 of the limiting wall 9 into its locking position in the pressure-chamber-side end region of the recessed portion of the radial end face 20 and braces the drive pinion 2 and the winged wheel 3 of the device 1 against each other. The hollow space 30 formed in unlocking direction of the free-wheel 16 behind the clamping body 17 between the recessed portion of the radial end face 20 of the limiting wall 9 of the drive pinion 2 and the outer peripheral surface 29 of the wheel hub 11 of the winged wheel 3 can be depressurized through a vent duct 31, roughly indicated in FIG. 2, that is configured as a radial groove in the side wall 5 of the drive pinion 2 and serves to discharge leaked pressure medium collecting in the hollow space 30.

What is claimed is:

1. A hydraulic camshaft adjusting device of a rotary piston type for varying valve timing of gas exchange valve in an internal combustion engine, said device comprising:

a drive pinion connected in driving relationship to a crankshaft of the internal combustion engine and a winged wheel connected rotationally fast to a camshaft of the internal combustion engine, said drive pinion comprising a hollow space formed by a hollow cylindrical circumferential wall and two side walls, at least one hydraulic working chamber being formed in the hollow space by at least two radial limiting walls, at least one wing arranged on an outer periphery of a wheel hub of the winged wheel extending radially into the at least one working chamber and dividing this working chamber into two oppositely acting hydraulic pressure chambers, by a selective or simultaneous pressurizing by a hydraulic pressure medium, the pressure chambers effect a pivoting or a fixing of the winged wheel relative to the drive pinion, and thus, of the camshaft relative to the crankshaft, on switching-off of the internal combustion engine, an auxiliary energy acting between the winged wheel and the drive pinion rotates the camshaft into a preferred basic position for starting the internal combustion engine, in the basic position of the camshaft, the winged wheel can be mechanically coupled to the drive pinion by a lock that can be hydraulically unlocked again upon renewed pressurizing of the device, wherein the lock for mechanically coupling the winged wheel to the drive pinion is formed by at least one cage-guided free-wheel arranged between the winged wheel and the drive pinion, said lock comprises at least one clamping body that blocks a direction of rotation of the winged wheel opposed to the basic position of the camshaft, and at least parts of a surface of a cage of the free-wheel are configured as a pressure application surface for the hydraulic pressure medium for a hydraulic unlocking of the free-wheel.

2. A device of claim 1 wherein the lock of the device is formed by only one cage-guided free-wheel that comprises only one clamping body that is configured as a rolling bearing needle roller, the cage being made of a heat-resistant plastic.

3. A device of claim 1 wherein the cage of the free-wheel has an L-shaped cross-sectional profile and is arranged within a likewise L-shaped angular recess made at least partly in a radial end face and at least partly in a wing stop surface of one of the limiting walls of the drive pinion.

4. A device of claim 3 wherein the pressure application surface for the pressure medium is configured on one side of a first profile leg of the cage of the free-wheel, while another side of the first profile leg is operatively connected to a spring means that is supported on a recessed portion of the wing stop surface of the limiting wall and acts in locking direction of the free-wheel.

5. A device of claim 3 wherein a collar having a circular cross-sectional profile is formed on a free end of the first profile leg of the cage of the free-wheel, and the collar serves to positively arrest the free-wheel in an additional circular groove made in the recessed portion of the wing stop surface of the limiting wall.

6. A device of claim 3 wherein the clamping body is mounted in a second profile leg of the cage of the free-wheel while being arranged between an outer peripheral surface of the wheel hub of the free-wheel and a recessed portion of the radial end face of the limiting wall of the drive pinion, which recessed portion tapers conically in locking direction of the free-wheel.

7. A device of claim 6 wherein a hollow space formed behind the clamping body in unlocking direction of the free-wheel between the recessed portion of the radial end face of the limiting wall of the drive pinion and the outer peripheral surface of the wheel hub of the free-wheel can be depressurized through an additional vent duct made in the form of a radial groove in one of the side walls of the drive pinion.

* * * * *